US007533765B2

(12) United States Patent
Kwon

(10) Patent No.: US 7,533,765 B2
(45) Date of Patent: May 19, 2009

(54) SHOCK ABSORBING DEVICE FOR PASSENGER CONVEYORS

(75) Inventor: Yi Sug Kwon, Changwon-si (KR)

(73) Assignee: Otis Elevator Company, Farmington, CT (US)

( * ) Notice: Subject to any disclaimer, the term of this patent is extended or adjusted under 35 U.S.C. 154(b) by 0 days.

(21) Appl. No.: 11/579,033

(22) PCT Filed: May 10, 2005

(86) PCT No.: PCT/US2005/016483

§ 371 (c)(1),
(2), (4) Date: Nov. 13, 2007

(87) PCT Pub. No.: WO2005/113393

PCT Pub. Date: Dec. 1, 2005

(65) Prior Publication Data

US 2008/0087522 A1 Apr. 17, 2008

(30) Foreign Application Priority Data

May 13, 2004 (KR) ..... 10-2004-0033767

(51) Int. Cl.
*B66B 23/12* (2006.01)

(52) U.S. Cl. ..... 198/332; 198/321; 198/322; 198/323

(58) Field of Classification Search ..... 198/321, 198/322, 323, 332
See application file for complete search history.

(56) References Cited

U.S. PATENT DOCUMENTS

| | | | | |
|---|---|---|---|---|
| 3,834,513 | A * | 9/1974 | Miura et al. | 198/332 |
| 4,232,776 | A * | 11/1980 | Dean | 198/322 |
| 4,249,649 | A * | 2/1981 | Kraft | 198/332 |
| 4,739,870 | A | 4/1988 | Saito | |
| 4,805,763 | A * | 2/1989 | Kitamura et al. | 198/332 |
| 5,330,042 | A * | 7/1994 | Ogimura et al. | 198/333 |
| 6,016,902 | A * | 1/2000 | Kwon | 198/332 |
| 6,247,575 | B1 * | 6/2001 | Thiel | 198/330 |
| 6,382,388 | B1 | 5/2002 | Hirai et al. | |
| 6,427,823 | B1 * | 8/2002 | Ishikawa et al. | 198/330 |
| 6,685,003 | B2 | 2/2004 | Copeland et al. | |
| 6,832,678 | B2 | 12/2004 | Ogura et al. | |
| 7,357,241 | B2 * | 4/2008 | Schmidt et al. | 198/333 |

OTHER PUBLICATIONS

International Search Report and Written Opinion of the International Searching Authority for PCT/US2005/016483, dated Nov. 3, 2005.

* cited by examiner

*Primary Examiner*—Douglas A Hess
(74) *Attorney, Agent, or Firm*—Carlson, Gaskey & Olds

(57) ABSTRACT

A shock-absorbing device for passenger conveyors comprises shock-absorbing members, which are attached respectively to at least one side of each of an inner rail and an outer rail of a track and protrude from the inner and outer rails toward a step roller. Supporting members are attached to the shock absorbing members for supporting the shock-absorbing members together with the inner rail and the outer rail.

7 Claims, 4 Drawing Sheets

SHOCK ABSORBING DEVICE FOR PASSENGER CONVEYORS

FIELD OF THE INVENTION

The present invention generally relates to a passenger conveyor system, and more particularly to a device for absorbing shocks generated when step rollers collide with rails in turn around areas at the top and bottom of the passenger conveyor.

BACKGROUND OF THE INVENTION

A typical passenger conveyor, such as an escalator or moving walk, includes a frame, balustrades with movable handrails, steps, and a drive system and a step chain for propelling the steps. The frame includes a truss section on both left and right hand sides of the frame. Each truss section has two end sections forming landings, which are connected by an inclined midsection. The upper landing usually houses the escalator drive system or machine positioned between the trusses.

The drive system of the escalator typically consists of a step chain, a step chain drive sprocket, an axle and a drive motor. The drive motor drives the step chain to travel in a continuous closed loop.

As shown in FIGS. 1 and 2, steps 10, which are attached to a step chain 12, run from one landing to the other in order to transport the passengers.

Support levers 16 are fixedly coupled to both sides of the step 10. Each support lever 16 is provided with a step roller 18, which is rotatably mounted to an end of the support lever 16. The step roller 18 guides the movement of the step 10 and supports the same.

An escalator has a track 20 on both left and right sides, along which the step roller 18 travels in a continuous closed loop. The track 20 is substantially parabolic in shape at the turn around areas located under the lower landing and the upper landing. This is so that the step roller 18 and the step 10 can make a 180 degree heading change at the turn around areas.

The track 20 includes an inner rail 22 and an outer rail 24 that is disposed outward of the inner rail 22. The gap between the inner rail 22 and the outer rail 24 is set to be larger than the diameter of the step roller 18 by about 2 mm to 3 mm.

At the passenger conveying area, the step roller 18 rolls on the inner rail 22 of the track 20. Since the step 10 moves upward, the step roller 18 rises from the inner rail 22 to the outer rail 24 when the step roller 18 advances into the curved portion of the track 20 at the upper turn around area. This is due to the inertia of the moving step 10. Thus, the step roller 18 tends to collide with the outer rail 24. Then, the step roller 18 descends toward the lower landing with rolling on the outer rail 24 and returns onto the inner rail 22 at the lower turn around area.

However, the collisions of the step roller 18 with the rails 22 and 24 of the track 20 cause noise and operational instability, thus making the passengers feel very uncomfortable. Such collisions may even lead to the malfunction of the escalator.

To solve this problem, as shown in FIG. 3, a prior art shock absorbing device for an escalator consists of leaf springs 22*a* and 24*a*, which are formed at the inner rail 22 and the outer rail 24 of the track 20, respectively. The leaf springs 22*a* and 24*a* serve as shock-absorbing means. The step roller 18 advancing into the upper curved portion of the track 20 bounces from the leaf spring 22*a* of the inner rail 22 and collides with the outer rail 24. The leaf spring 24*a* of the outer rail 24 vibrates in order to absorb shock and reduce noise.

However, the above prior art shock absorbing device for an escalator requires troublesome calculation of spring constants and high precision of a gap between the inner rail and the outer rail. This is so that the leaf springs may sufficiently absorb the shocks resulting from the collisions of the step roller. Further, since the leaf springs tend to get deformed by repeated collisions with the step roller, frequent repairs are required.

SUMMARY OF THE INVENTION

It is an object of the present invention to overcome the problems of the prior art and provide an improved shock absorbing device for passenger conveyors.

It is another object of the present invention to provide a shock absorbing device for passenger conveyors which can be easily designed and manufactured, while requiring little maintenance.

Consistent with the foregoing objects, and in accordance with the invention as embodied herein, there is provided a shock absorbing device for a passenger conveyor. The passenger conveyor includes: 1) steps circulating a closed loop; 2) a track having an inner rail and an outer rail and providing the circulating loop of the steps; and 3) a step roller connected to each step and rolling between the inner rail and the outer rail. The shock absorbing device of the present invention comprises: 1) shock-absorbing members that are attached respectively to either side of the inner rail and the outer rail, wherein the shock-absorbing members protrude from the inner rail and the outer rail toward the step roller; 2) and supporting members, which are attached to the shock-absorbing members for supporting the shock-absorbing members together with the inner rail and the outer rail.

A gap between the shock-absorbing member and the step roller is about 0.7 mm to 2.5 mm. The shock-absorbing member is made of a neoprene material, which has Shore hardness of about 55 to 65. The thickness of the shock-absorbing member is more than about 30% of the width of the step roller. The width of the shock-absorbing member is more than the radius of the step roller.

The supporting members are attached to the sides of the shock-absorbing members opposite to the inner and outer rails. The width of the supporting member is more than about a half of the width of the shock-absorbing member.

BRIEF DESCRIPTION OF DRAWINGS

The above objects and features of the present invention will become more apparent from the following description of the preferred embodiments given in conjunction with the accompanying drawings.

DETAILED DESCRIPTION OF THE PRESENT INVENTION

Figure 1:
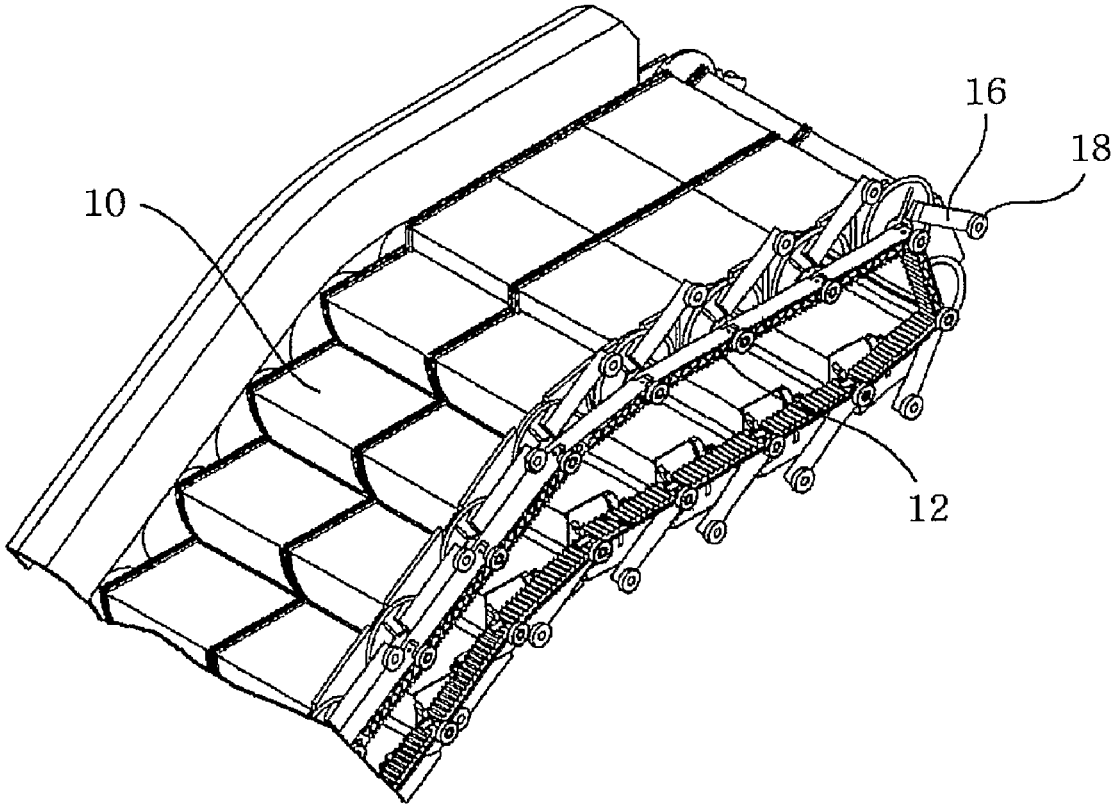
Fig. 1 (Prior Art)
FIG. 1 is a perspective view schematically showing steps and a step chain of a conventional escalator.
Figure 2:
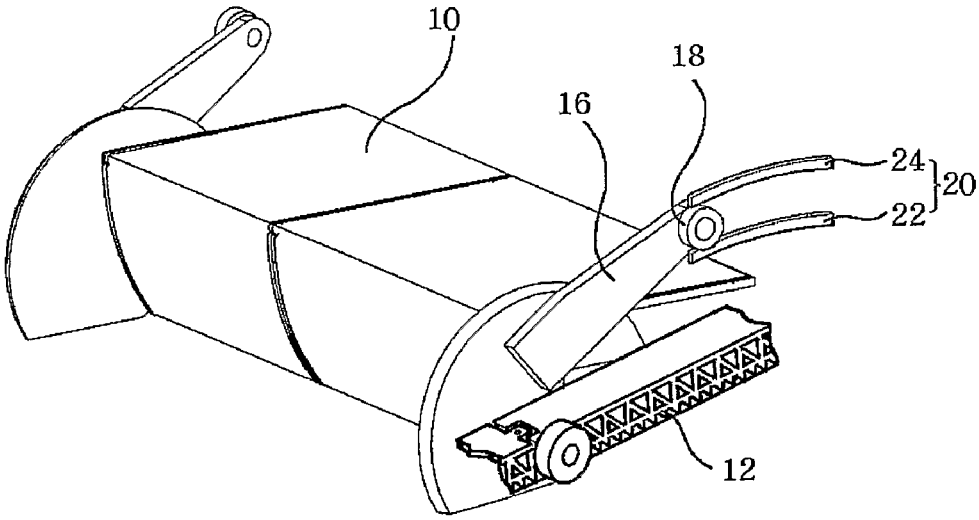
Fig. 2 (Prior Art)
FIG. 2 is a perspective view showing a mounting structure of a step roller and a track of a conventional escalator.
Figure 3:
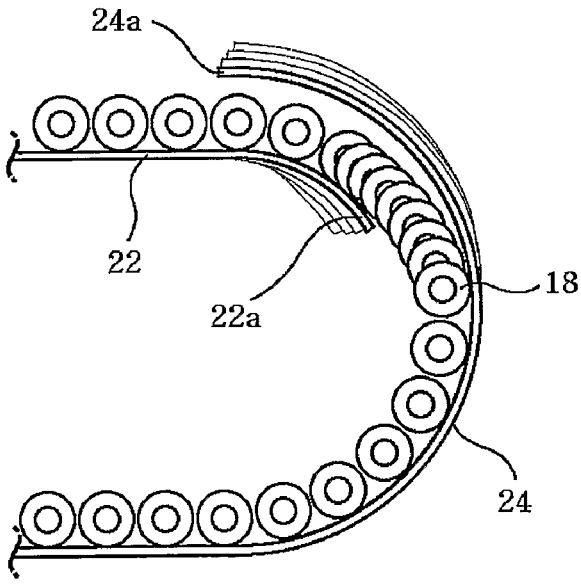
Fig. 3 (Prior Art)
FIG. 3 is a side view showing a prior art shock absorbing device for an escalator.
Figure 4A:
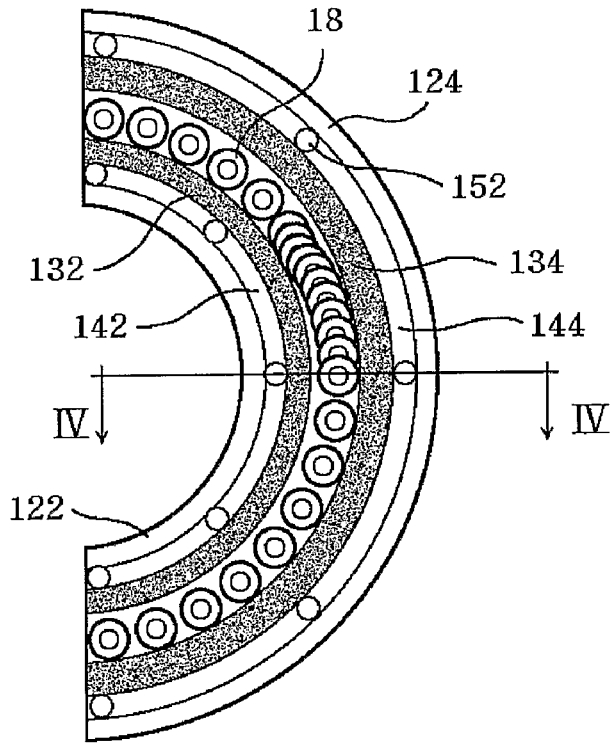
FIG. 4*a* is a side view showing a shock absorbing device for an escalator in accordance with a first preferred embodiment of the present invention.
Figure 4B:
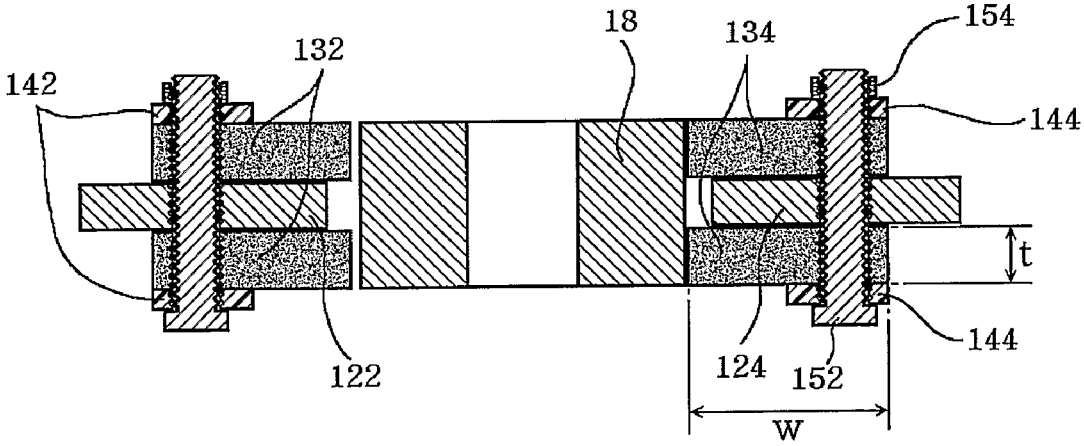
FIG. 4*b* is a cross-sectional view taken along line IV-IV in FIG. 4*a*.

FIG. 4*a* is a side view showing a shock absorbing device for an escalator in accordance with a first preferred embodiment of the present invention. FIG. 4*b* is a cross-sectional view taken along line IV-IV in FIG. 4*a*.

As shown in the drawings, the track for guiding the step roller 18 includes an inner rail 122 and an outer rail 124 that is disposed outward of the inner rail 122. The gap between the inner rail 122 and the outer rail 124 is set to be larger than the diameter of the step roller 18 by a specific size.

Shock-absorbing members 132 and 134 are attached to both sides of the inner rail 122 and the outer rail 124, respectively. Each shock-absorbing member 132 and 134 has a predetermined thickness t and width w, and has the same radius of curvature as those of the rails 122 and 124 at the turn around area. The shock-absorbing members 132 and 134 protrude from the inner and outer rails 122 and 124 toward the step roller 18. This is to prevent the step roller 18 from directly contacting the inner and outer rails 122 and 124. According to this embodiment of the invention, the gap between the two shock-absorbing members 132 and 134 is set to be larger than the diameter of the step roller 18 by about 0.7 mm to 2.5 mm, and preferably 1.0 mm. To better absorb the shock by the step roller 18, the thickness t of each shock-absorbing member 132 or 134 is more than about 30% of the width of the step roller 18, while the width w is more than the radius of the step roller 18. The shock-absorbing members 132 and 134 are made of a neoprene or engineering plastic material, which has Shore hardness of about 55 to 65, and preferably 60.

The rigid supporting members 142 and 144 are attached to the sides of the shock-absorbing members 132 and 134, which are opposite to the inner and outer rails 122 and 124, in order to enhance the durability of the shock-absorbing members 132 and 134. Preferably, the width of each supporting member 142 or 144 is more than about a half of that of each shock-absorbing member 132 or 134. The supporting members 142 and 144 and the shock-absorbing members 132 and 134 are fixed together to the inner and outer rails 122 and 124 by fastening means such as bolts 152, nuts 154, etc. Accordingly, the supporting members 142 and 144 prevent the shock-absorbing members 132 and 134 from breaking or being separated from the rails 122 and 124 by the collisions with the step roller 18.

The operational effects of the shock absorbing device for an escalator according to the present invention will be described hereinafter based on the assumption that the escalator moves upward.

When the escalator moves upward, the step roller 18 rolls on the shock-absorbing member 132 of the inner rail 122 at the passenger conveying area. As shown in FIG. 4*a*, when the step roller 18 advances into the upper curved portion of the track at the upper turn around area, the step roller 18 tends to rise toward the outer rail 124 due to the inertia of the moving step. Thus, the step roller 18 bounces from the shock-absorbing member 132 of the inner rail 122 and collides with the shock-absorbing member 134 of the outer rail 124, while the shock-absorbing member 134 becomes compressed, thereby absorbing shock and reducing noise.

Figure 5:
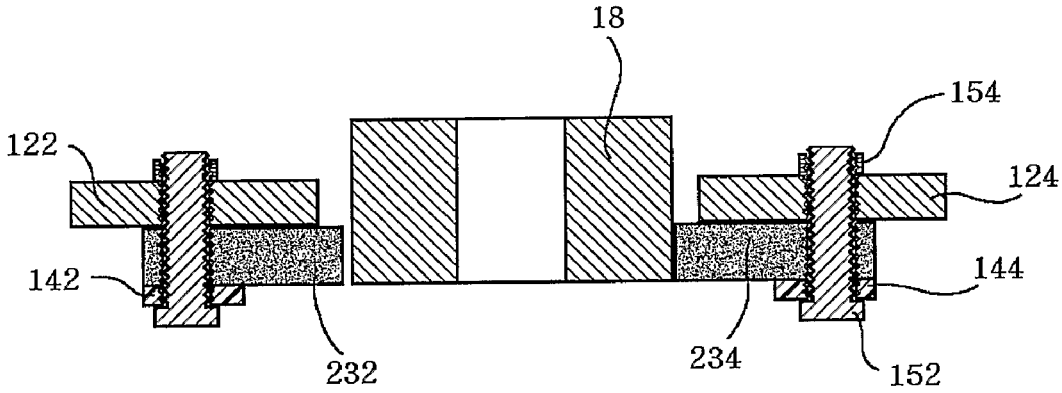
FIG. 5 is a cross-sectional view showing a shock absorbing device for an escalator in accordance with a second preferred embodiment of the present invention.

FIG. 5 shows a shock absorbing device for an escalator in accordance with a second embodiment of the present invention.

As shown in the drawing, shock-absorbing members 232 and 234 are attached to only one of two sides of the inner rail 122 and outer rail 124, respectively. The shock-absorbing member 232 and 234 protrude from the inner and outer rails 122 and 124 toward the step roller 18. Such a structure is for reducing manufacturing costs and simplifying maintenances in comparison with the above-described first embodiment. However, it does not compromise the shock absorbing efficiency.

Figure 6:
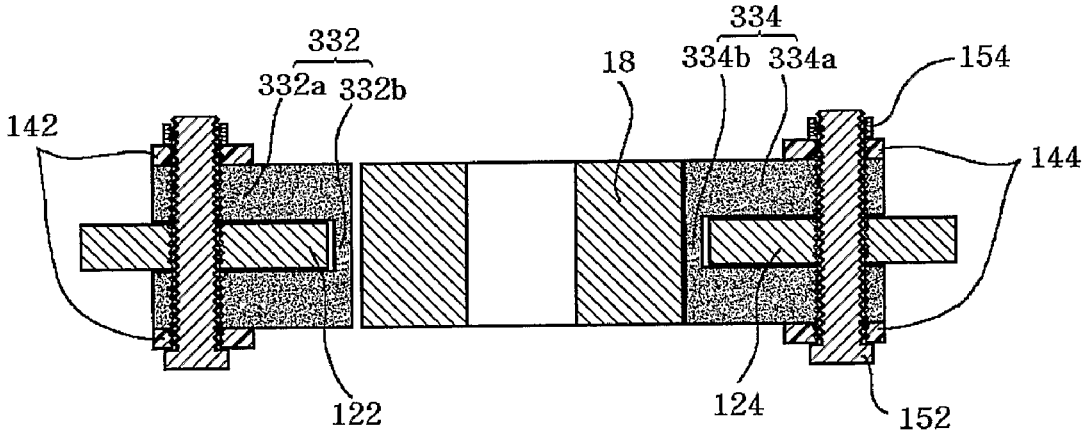
FIG. 6 is a cross-sectional view showing a shock absorbing device for an escalator in accordance with a third preferred embodiment of the present invention.

FIG. 6 shows a shock absorbing device for an escalator in accordance with a third embodiment of the present invention.

Shock-absorbing members 332 and 334 are formed in a "ㄷ" shape, each having a pair of side portions 332*a* and 334*a* protruding toward the step roller 18 and a connecting portion 332*b* and 334*b* connecting the side portions 332*a* and 334*a*. This is to contact and surround three surfaces (i.e., two sides and the surface facing the step roller 18) of the inner rail 122 and outer rail 124. Therefore, the shock-absorbing members 332 and 334 support the step roller 18 over the full width of the step roller 18 to thereby enhance shock-absorbing and noise-reducing performances and improve structural stability.

All manufacturing conditions such as the size and material of the shock-absorbing members 232, 234, 332 and 334 of the second and third embodiments are same as those of the shock-absorbing members 132 and 134 of the above-mentioned first embodiment. Also, the structures of the rigid supporting members 142 and 144 (for enhancing the durability of the shock-absorbing members 232, 234, 332 and 334) of the second and third embodiments, and of the fastening means such as the bolts 152 and nuts 154 (for fixing these components together to the rails 122 and 124) are same as those of the first embodiment.

As described above in detail, the shock absorbing device for passenger conveyors according to the present invention is embodied in shock-absorbing members, which are attached respectively to either side of an inner rail and an outer rail of a track and protrude from the inner rail and the outer rail toward a step roller. As such, the shock absorbing device and the track can be easily designed and manufactured without troublesome calculation of spring constants and requirement for high precision of a gap between the inner rail and the outer rail (as the prior art). They further require less maintenance.

Further, the device of the present invention can maintain a high shock absorbing effect during a long period of operations, thereby providing the passengers with comfort and prolonging the life of the step roller.

The present invention may be embodied in other specific forms without departing from its spirit or essential characteristics. The described embodiments are to be considered in all respects only as illustrative and not restrictive. The scope of the invention is, therefore, indicated by the appended claims, rather than by the foregoing description. All changes, which come within the equivalent meaning and range of the claims, are to be embraced within their scope.

What is claimed is:

1. A shock absorbing device for a passenger conveyor, the passenger conveyor including steps circulating a closed loop; a track having an inner rail and an outer rail and providing the circulating loop of the steps, and a step roller connected to each step and rolling between the inner rail and the outer rail, the shock absorbing device comprising:

shock-absorbing members attached respectively to at least one side of each of the inner rail and the outer rail, the shock-absorbing members protruding from the inner rail and the outer rail toward the step roller such that the step roller does not directly contact the inner and outer rails, and separate supporting members attached to the sides of the shock-absorbing members opposite the inner and outer rails for supporting the shock-absorbing members together with the inner rail and the outer rail.

2. The shock absorbing device of claim 1, wherein a gap between the shock-absorbing member and the step roller is about 0.7 mm to 2.5 mm.

3. The shock absorbing device of claim 1, wherein the shock-absorbing member is made of a material having a Shore hardness of about 55 to 65.

4. The shock absorbing device of claim 3, wherein the material comprises a neoprene material.

5. The shock absorbing device of claim 3, wherein a thickness of the shock-absorbing member is more than about 30% of a width of the step roller.

6. The shock absorbing device of claim 5, wherein a width of the shock-absorbing member is more than the radius of the step roller.

7. The shock absorbing device of claim 6, wherein the separate supporting members attached to the shock-absorbing members for supporting the shock-absorbing members together with the inner rail and the outer rail, further comprising:

each have a width of is more than about a half of the width of the shock-absorbing member.

* * * * *